US007690297B1

(12) United States Patent
Sagen et al.

(10) Patent No.: US 7,690,297 B1
(45) Date of Patent: Apr. 6, 2010

(54) BALER TIE FEED APPARATUS

(75) Inventors: Stephen W. Sagen, Harmony, MN (US); Steven W. Scrabeck, Harmony, MN (US)

(73) Assignee: Harmony Enterprises, Inc., Harmony, MN (US)

( * ) Notice: Subject to any disclaimer, the term of this patent is extended or adjusted under 35 U.S.C. 154(b) by 0 days.

(21) Appl. No.: 12/284,257

(22) Filed: Sep. 22, 2008

(51) Int. Cl.
*B65B 13/02* (2006.01)

(52) U.S. Cl. ..... 100/3; 100/19 R; 100/24; 100/98 R; 100/245

(58) Field of Classification Search ..... 100/3, 100/8, 11, 17, 19 R, 24, 34, 98 R, 218, 240, 100/245
See application file for complete search history.

(56) References Cited

U.S. PATENT DOCUMENTS 228,515 A * 6/1880 Cook ..... 100/8
3,528,364 A * 9/1970 Freund ..... 100/3
3,827,349 A * 8/1974 Gilman ..... 100/98 R
4,232,599 A * 11/1980 Ulrich ..... 100/25
4,718,336 A * 1/1988 Munro ..... 100/3
5,699,727 A * 12/1997 Schwelling ..... 100/3
5,852,969 A * 12/1998 Anthony ..... 100/34
7,237,477 B1 * 7/2007 Fox et al. ..... 100/3

* cited by examiner

*Primary Examiner*—Jimmy T Nguyen
(74) *Attorney, Agent, or Firm*—William J. Ryan

(57) ABSTRACT

A baler tie feed apparatus is provided having a compaction chamber, a platen and a door, wherein aligned channels are defined within the top and bottom of the compaction chamber, the platen and the door so as to define a plurality of continuous open channels surrounding a bale of compacted material having horizontal top and bottom portions and vertical front and rear portions. A tie feed apparatus is provided which comprises a plurality of elongate tie engaging members, each of which engages tying media inserted through the top and rear portions of the channels and is advanced to thread the tying media through the bottom portion of the channels.

9 Claims, 12 Drawing Sheets

BALER TIE FEED APPARATUS

BACKGROUND OF THE INVENTION

The present invention generally relates to a baler tie feed apparatus useful in conjunction with a baler used to compact loose material, such as trash, refuse and recyclables, into dense, compact bales. The invention has specific utility in tying a bale of compacted material to maintain its compacted size and shape once the bale is discharged from the baler.

It is well known to compact loose material by means of a refuse or recycling baler into dense, tightly packed bales to facilitate the transfer, storage, disposal and/or recycling of such material. The types of material which may be so compacted range from agricultural products, such as straw, hay, cotton and the like, to trash, refuse and recyclables. For the purpose of this discussion, the material will be referred to as trash, refuse or recyclables, although it will be apparent that the present invention has utility with respect to the compaction of such other materials as well.

Such balers typically consist of a hopper into which the material to be compacted is deposited, a compaction chamber in which the bale of compacted material is formed and a ram or platen which is activated to move the material from the hopper into the compaction chamber in which the material is compacted into a compact, dense bale. Once a bale is so formed, the platen is withdrawn and the bale discharged from the compaction chamber. Upon discharge from the compaction chamber, however, the compacted material in the bale will not maintain its shape, but tends to expand and increase in size. It is well known to tie the compacted bale with various media (such as twine, string, wire and metal banding) to minimize the size of the bale for handling, transfer, storage and/or disposal.

A number of different tying arrangements have been utilized for this purpose. The most basic tying arrangement includes manually wrapping the tying media around the bale after the bale is released from the baler and securing the opposed ends of the tying media once the bale is so wrapped. Since the material in the bale expands fairly quickly once the bale is removed from the baler, it is important to complete such manual wrapping as soon as possible to keep the expansion of the bale to a minimum. It is inevitable that some expansion will occur, however, no matter how quickly the bale is wrapped.

To solve the problems inherent with wrapping the bale manually after it is removed from the baler, it has been known to provide various means to wrap the bale while it is still in the baler and before it has an opportunity to expand. The primary challenge to be overcome in so doing is to wrap the bale with tying media while the bale is still located within the structure of the compaction chamber and the platen is in place. The prior art devices typically involve providing channels or openings within the compaction chamber and platen through which the tying media may be threaded to encircle the bale while the bale is in its most compacted form and prior to discharging the bale from the baler. These prior art solutions present their own set of problems, however.

One example of such prior art bale wrapping devices is disclosed in U.S. Pat. No. 3,528,364 to Freund. In that instance, a wire carrier is disclosed which moves partially around the bale to wrap a number of baling wires around the bale once formed. Once the baling wires have encircled the bale, a wire twisting mechanism is activated to twist the opposed ends of the baling wires to tighten and secure them.

Another example of such prior art bale wrapping devices is disclosed in U.S. Pat. No. 4,232,599 to Ulrich. In that instance, a baler is provided in which channels or grooves are provided in the bottom of the ram (platen), rear and floor of the baler. The channels or grooves are aligned to define continuous channels or grooves around three sides of the bale. Once the bale is formed, the door is opened and a "fish tool" is inserted into each channel to draw a number of wires or cords around three sides of the bale. Once so drawn around the bale, the opposed ends of the wires or cords are tied to secure the bale.

Another example of the prior art bale wrapping devices is shown in U.S. Pat. No. 5,852,969 to Anthony. In this instance, a number of wedge-shaped, bale compression members are provided on the inner faces of opposed platens which cause compressed areas in a cotton bale as the same is being formed. Wires are threaded through the recesses in the compression members to encircle the bale. Once the opposed ends of the wires are secured, the platens are withdrawn and the wires remain in place around the bale by passing out of the recesses through an opening.

Still yet another example of the bale wrapping devices of the prior art is described in U.S. Pat. No. 6,971,307 to Daniel et al. In this instance, a bale encircling, movable guide track is provided having opposed sections defining a wire receiving groove. Once the guide track is in place, a wire is passed through the groove to encircle the bale. The opposed ends of the wire are secured by twisting, and the wire is tensioned to pull the wire from between the opposed sections of the guide track. At that point, the movable portions of the guide track are removed to leave the wire tied around the bale.

All of the prior art devices utilize complicated, detailed mechanisms which are expensive to construct and maintain.

BRIEF SUMMARY OF THE INVENTION

It is one object of the present invention to provide an apparatus for wrapping a bale of compacted material such as trash and refuse while the bale is still under pressure.

It is another object of the present invention to provide an apparatus for wrapping a bale of compacted material which is inexpensive and reliable in construction and operation.

To those ends, a baler tie feed apparatus is provided having a compaction chamber, a platen and a door, wherein aligned channels are defined within the top and bottom of the compaction chamber, the platen and the door so as to define a plurality of continuous open channels surrounding a bale of compacted material having horizontal top and bottom portions and vertical front and rear portions. The tying media (i.e., wire) is manually threaded though the top and rear portions of each channel until the end of the tying media is positioned adjacent the rear of the bottom portion of the channel. A tie feed apparatus is provided which comprises a plurality of elongate tie engaging members, each of which operates within the bottom portion of one of the channels between a rear position wherein the forward ends of each tie engaging member is located beneath the rear portion of one of the channels and a forward position wherein the forward ends of each tie engaging member is located beneath the front portion of one of the channels. The front ends of the tie engaging members are adapted to engage the tying media. A rack and pinion drive is provided to operate the tie feed apparatus between the rear and forward positions. In operation, once the tying media has been manually inserted through the top and rear portions of the desired channels, the tie feed apparatus is advanced from its rear position toward its forward position. In so doing, the front ends of the tie guiding members engage the corresponding tying media and thread it through the bottom portion of the corresponding channel until it reaches the front portion of the channel. At that point, the tying media can be manually grasped and extended upward through the front portion of the channel and secured to bind the bale.

DETAILED DESCRIPTION OF THE PREFERRED EMBODIMENT

Figure 1:
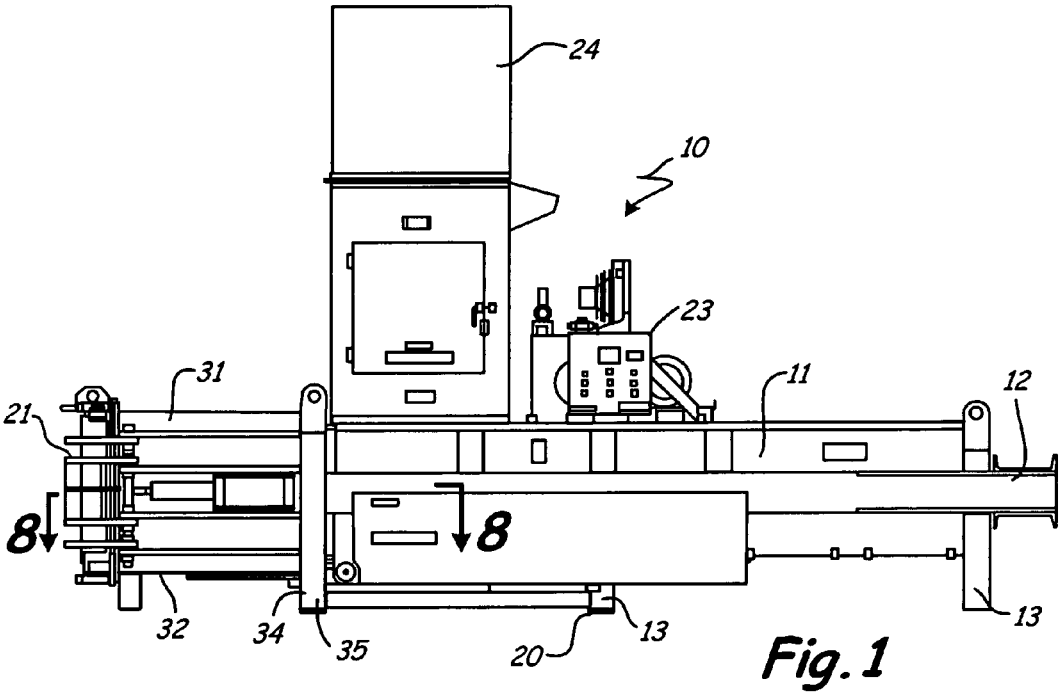
FIG. 1 is a side plan view of a refuse baler according to the present invention with the door in the closed position.
Figure 2:
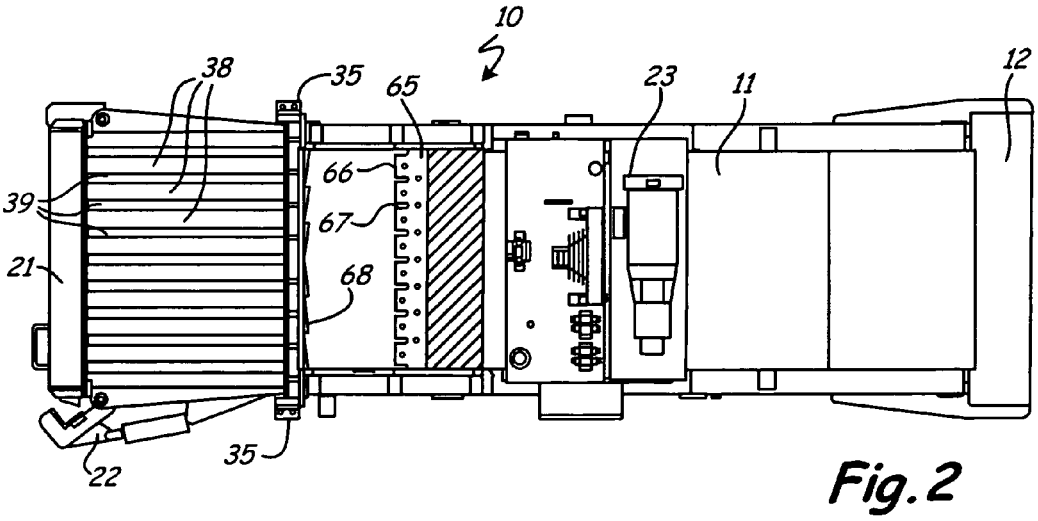
FIG. 2 is a top plan view of a refuse baler according to the present invention with the door in the closed position.
Figure 3:
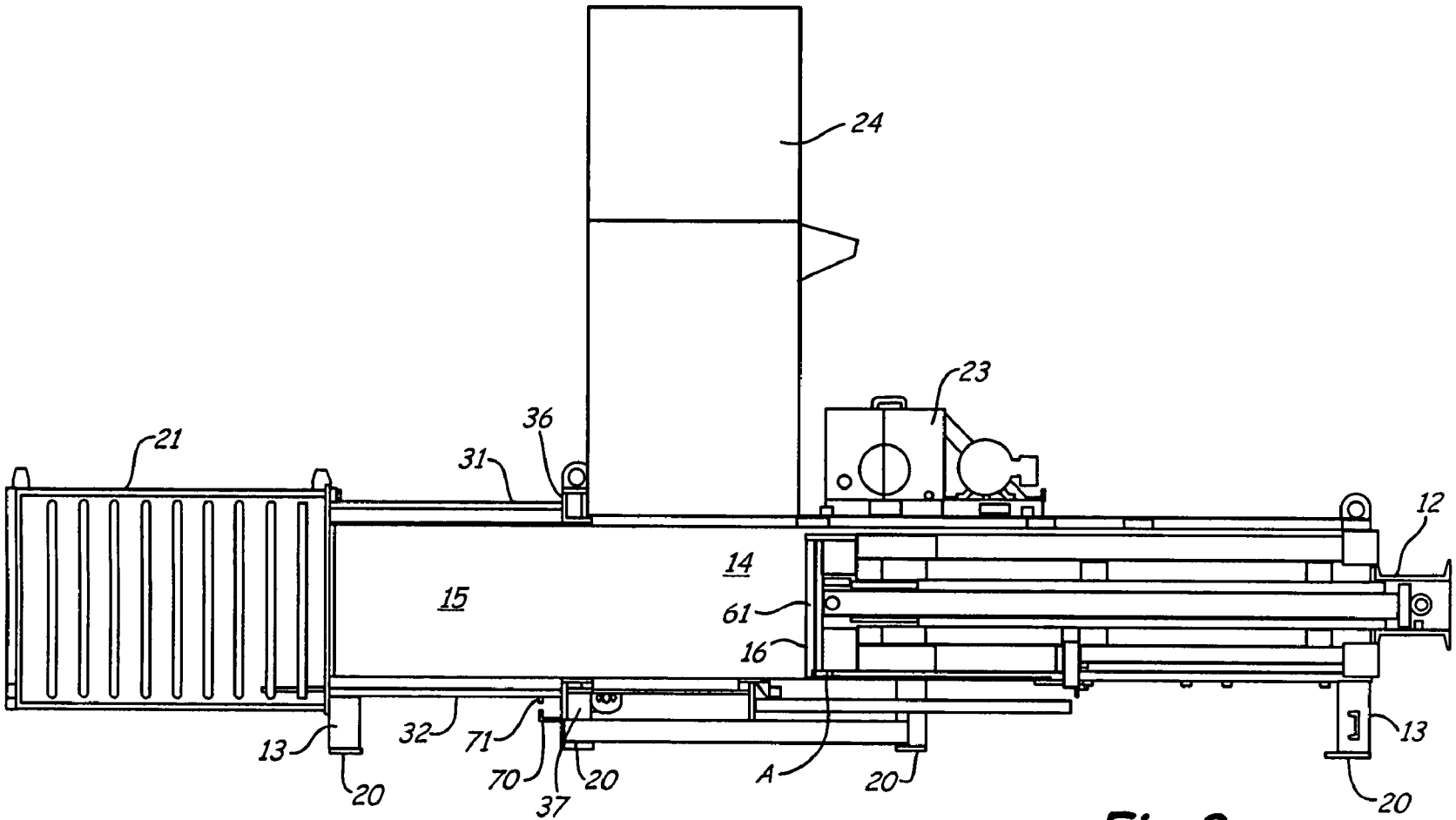
FIG. 3 is a side sectional view of a refuse baler according to the present invention with the door in an opened position, showing the platen in rear position A.
Figure 4:
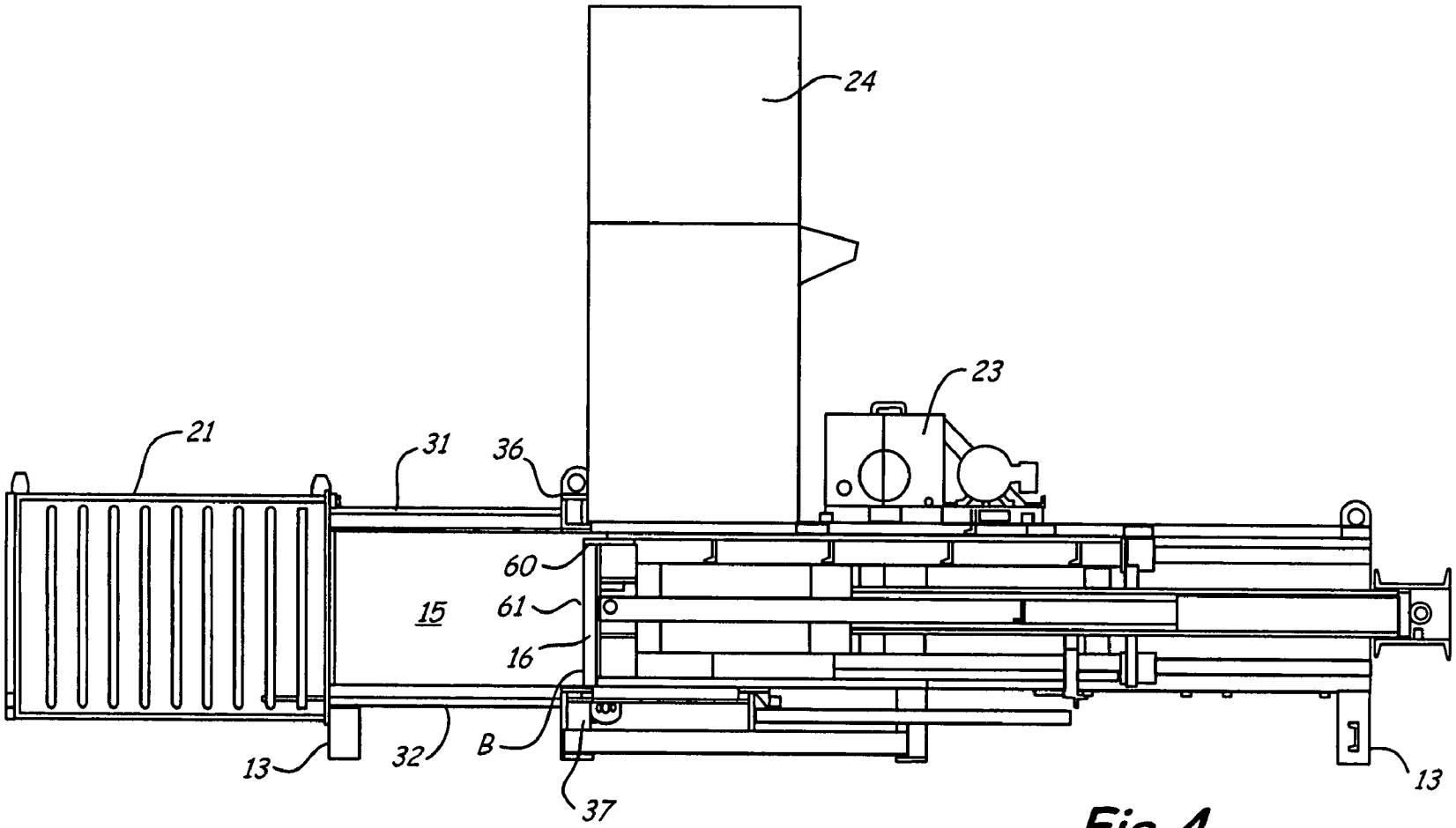
FIG. 4 is a side sectional view of a refuse baler according to the present invention with the door in an opened position, showing the platen in intermediate position B.

Referring to the drawing, wherein like numerals represent like elements throughout the several views, there is shown a trash or refuse baler generally designated by the numeral 10. Baler 10 comprises a housing 11 supported by a frame 12 having vertical frame members 13, and defines a compaction chamber 15 at the front of housing 11 and a hopper portion 14 positioned rearwardly of and adjacent to compaction chamber 15; and a platen 16 operable within housing 11 between a rear position A wherein the leading edge of platen 16 is positioned substantially along the same vertical plane as the rear of hopper portion 14, an intermediate position B wherein the leading edge of platen 16 is positioned substantially along the same vertical plane as the front of hopper portion 14, and a forward position C wherein the leading edge of platen 16 extends into compaction chamber 15 adjacent to the front of compaction chamber 15.

Frame 12 comprises spaced, vertical members 13 and spaced, upper and lower horizontal members (not shown) extending transversely of housing 11 and between the corresponding vertical members 13. Vertical members 13 have feet 20 at their lower ends to permit attachment of baler 10 to the floor once in the desired location.

The front end of compaction chamber 15 comprises a door 21 hinged at one side to swing outwardly to facilitate removal of a bale of compacted material from compaction chamber 15 once fully formed. Door 21 may be locked in a closed position by a hydraulically activated latch mechanism 22.

Baler 10 is provided with conventional controls. Platen 16 is operable between rear position A and forward position C by a power unit, generally shown as 23, having a motor, hydraulic pumps and valves, acting on hydraulic cylinders to extend and withdraw platen 16 from one position to another.

The general operation of baler 10 is as follows. With platen 16 in position A and door 21 closed and latched shut, material to be compacted is deposited into hopper portion 14 through an upwardly facing opening in housing 11 by means of chute 24. Once the material to be compacted is loaded into hopper portion 14, power unit 23 is activated (either manually or automatically) to advance platen 16 toward position C, thereby moving the material into compaction chamber 15 and compacting it. Platen 16 will advance until the point at which the resistance of the material being compacted prevents further advancement. The power unit 23 is activated to advance platen 16 for a predetermined amount of time, at the end of which a switch is triggered to reverse the direction of platen 16 to retract it toward position A. While being retracted, platen 16 moves at a constant speed. By measuring the amount of time it takes platen 16 to return to position B, the distance traveled by platen 16 while being retracted (and thus the depth of the compacted material in compaction chamber 15) can be determined. When such return time indicates that the bale is fully formed (i.e., compaction chamber 15 is full), platen 16 is stopped at position B while the bale is tied as is more fully described below. Once the bale is tied, door 21 is opened by unlatching latch mechanism 22 and platen 16 is advanced again toward position C to push the bale from compaction chamber 15. All of the foregoing operations are accomplished with conventional equipment and controls.

Compaction chamber 15 comprises a top portion 31, a bottom portion 32 and side portions 33 extending between front frame member 12 and compaction chamber frame 34.

Compaction chamber frame 34 has spaced, vertical side members 35 and spaced, upper and lower horizontal members 36, 37. Top portion 31 of compaction chamber 15 is formed by a number of parallel "U" shaped ceiling beams 38 attached at one end to the underside of upper horizontal member of front frame member 12 and at the other end to upper horizontal member 36 of compaction chamber frame 34. Ceiling beams 38 are oriented in such a manner that the webs of ceiling beams 38 face downwardly and form the ceiling of compaction chamber 15. Ceiling beams 38 are spaced to define a number of parallel channels 39 between them.

Similarly, bottom portion 32 of compaction chamber 15 is formed by a number of parallel "U" shaped floor beams 40 attached at one end to the top of lower horizontal member of front frame member 12 and at the other end to the top of lower horizontal member 37 of compaction chamber frame 34. Floor beams 40 are oriented in such a manner that the webs of floor beams 40 face upwardly and form the floor of compaction chamber 15. Floor beams 40 are spaced to define a number of parallel channels 41 between them. Each floor beam 40 is positioned directly below a ceiling beam 38 such that the channels 41 are located directly below a corresponding channel 39.

Figure 5:
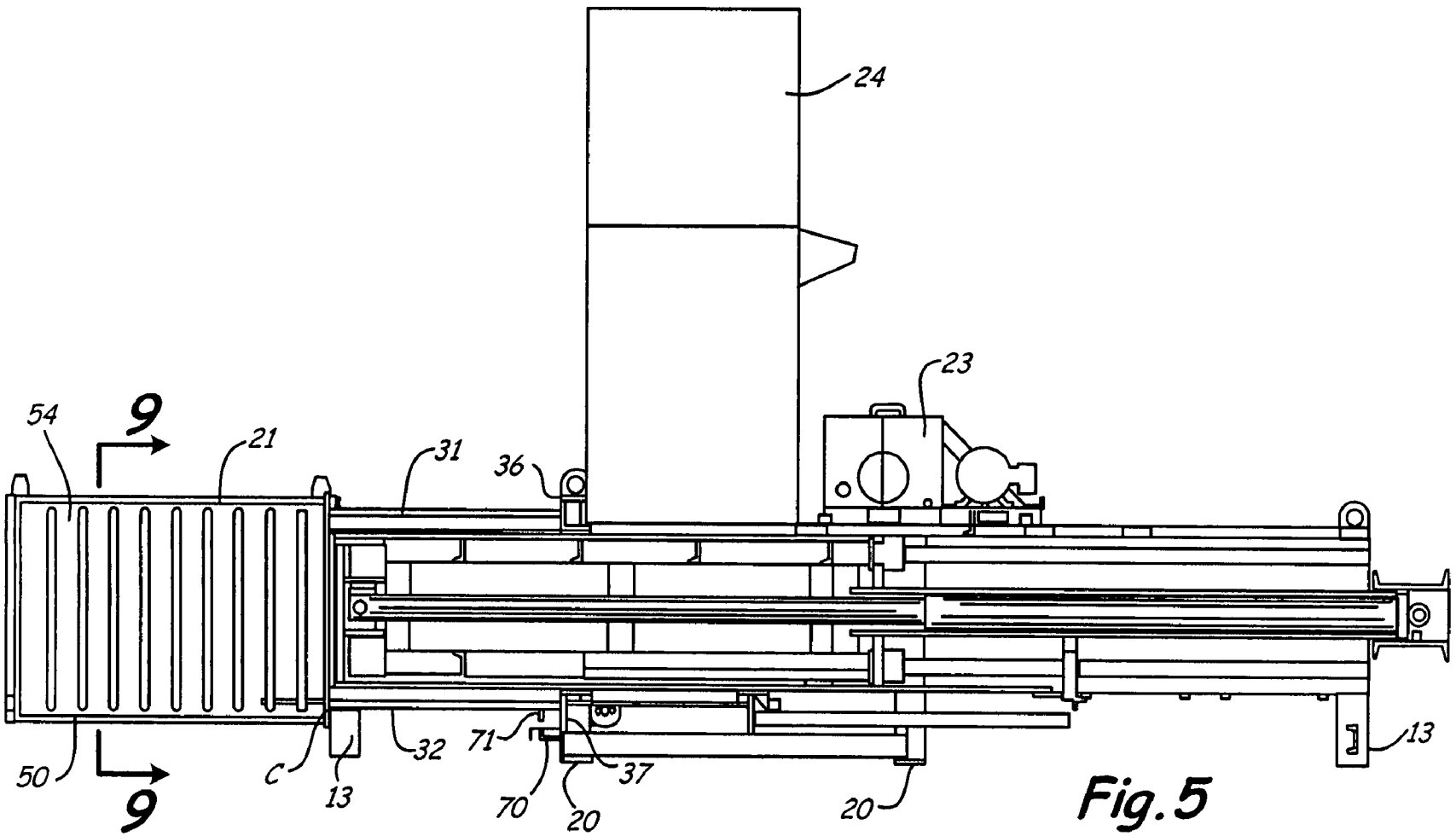
FIG. 5 is a side sectional view of a refuse baler according to the present invention with the door in an opened position, showing the platen in forward position C.
Figure 7:
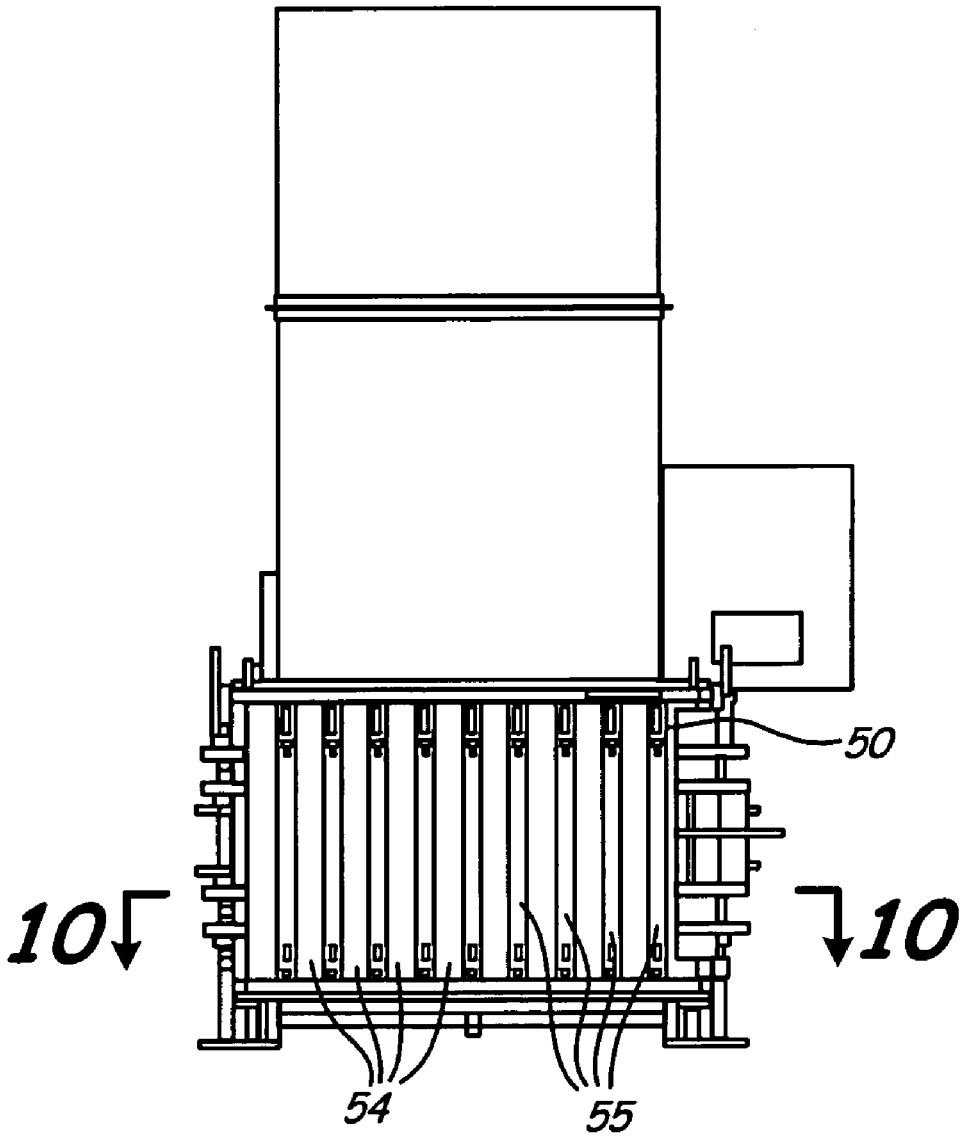
FIG. 7 is a front plan view of the compaction chamber of a refuse baler according to the present invention with the door latched in the closed position.
Figure 8:
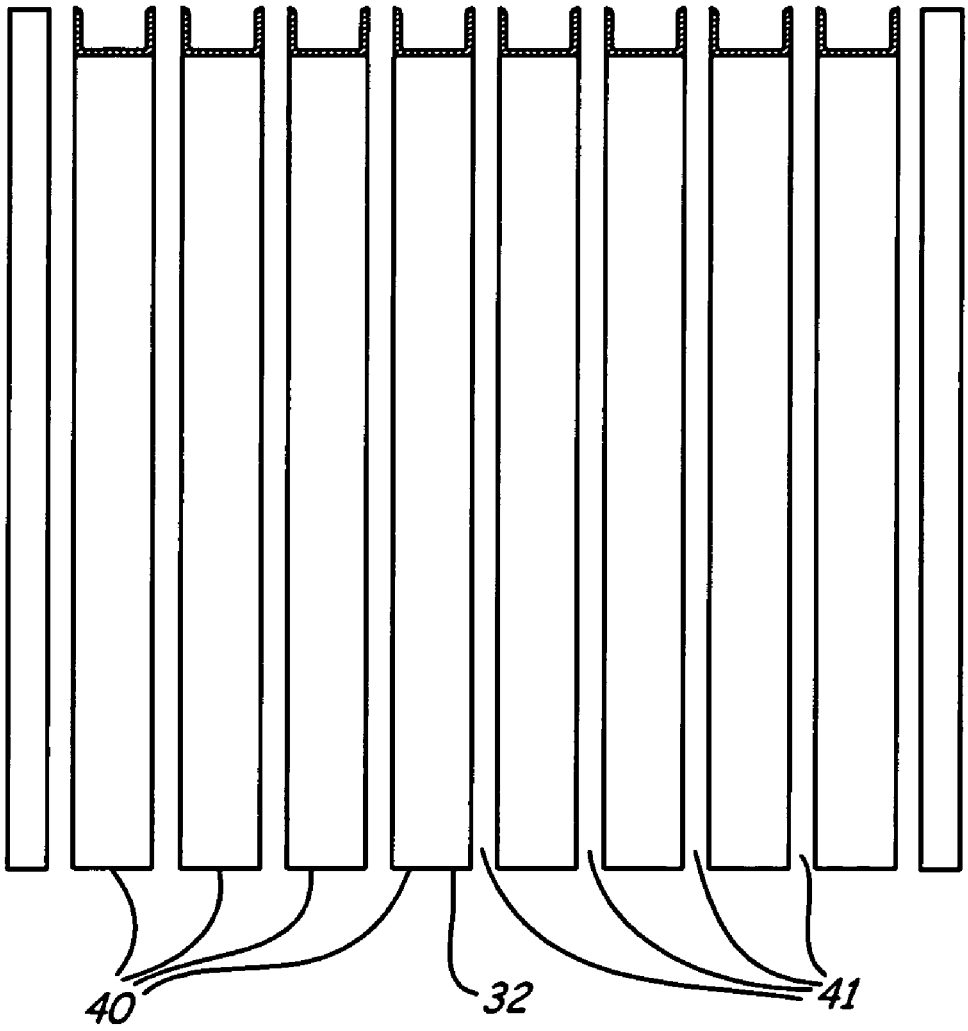
FIG. 8 is a top sectional view of the compaction chamber of a refuse baler according to the present invention taken along line 8-8 of FIG. 1.
Figure 10:
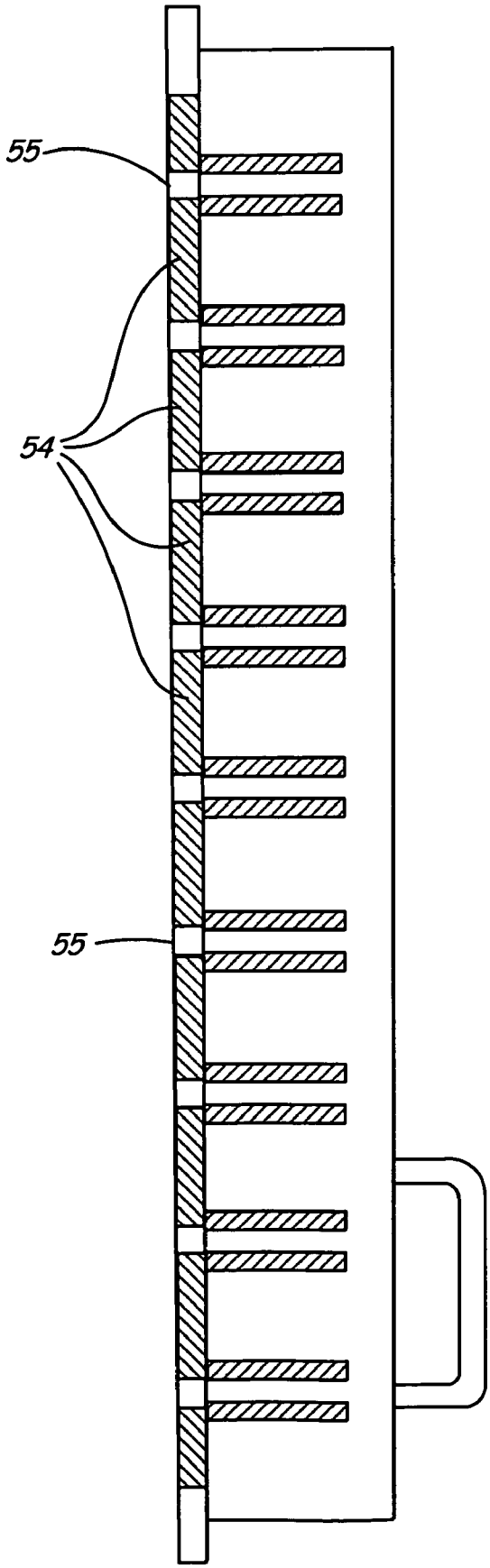
FIG. 10 is a top sectional view of the door of a refuse baler according to the present invention taken along the line 10-10 of FIG. 7.

Construction of door 21 is best understood with reference to FIGS. 5, 7 and 10. Door 21 comprises a door frame 50 having spaced, vertical side members, spaced, upper and lower horizontal members and a plurality of parallel, vertical "U" shaped door beams 54 attached at one end to the inside of upper horizontal member and at the other end to the insider of lower horizontal member. Door beams 54 are oriented in such a manner that the webs of door beams 54 face inwardly (or rearwardly) toward compaction chamber 15 when door 21 is closed and form the forward wall of compaction chamber 15 when door 21 is closed. Door beams 54 are spaced to define a number of parallel channels 55 between them. Each door beam 54 is aligned with a corresponding ceiling beam 38 and floor beam 40 such that channels 55 are aligned with corresponding channels 39 and 41.

Figure 6:
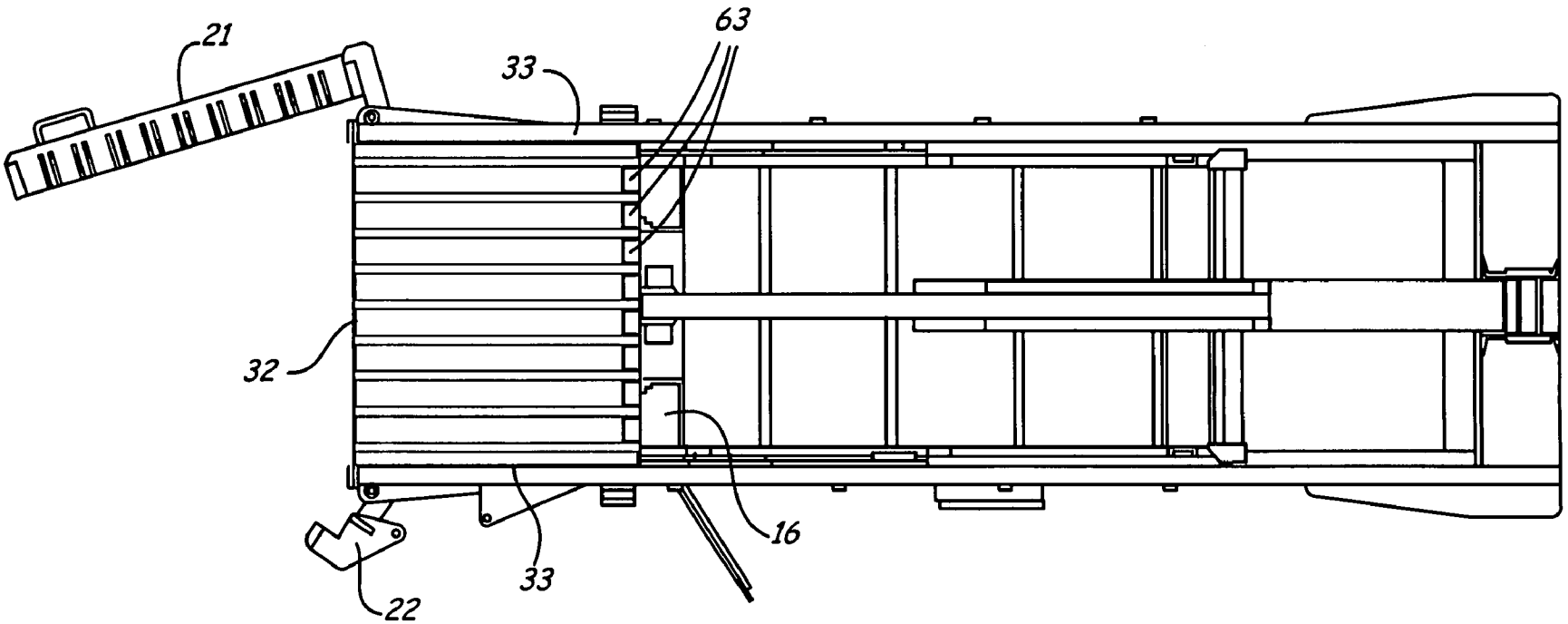
FIG. 6 is a top sectional view of a portion of a refuse baler according to the present invention with the door in an opened position.
Figure 9:
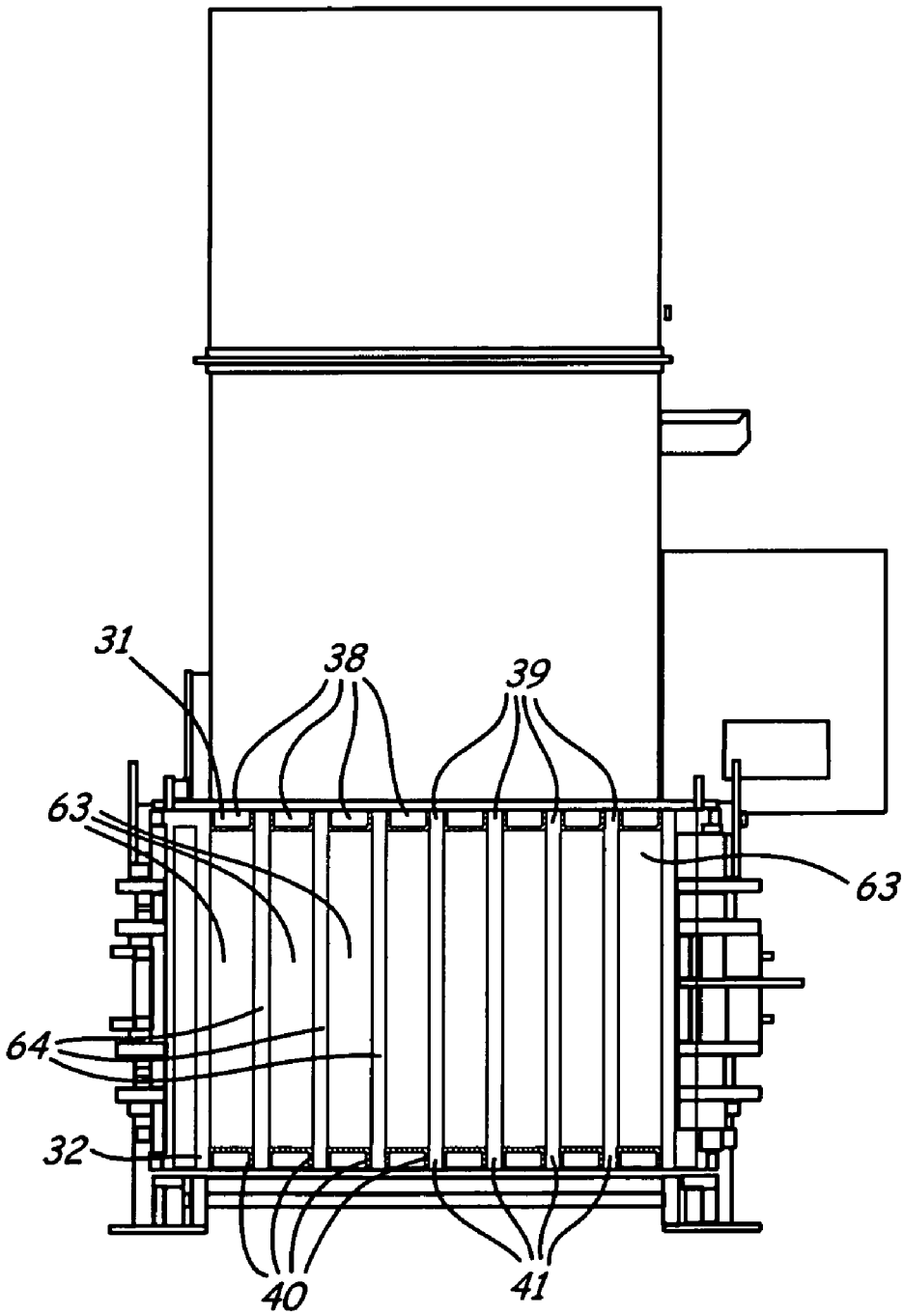
FIG. 9 is a front sectional view of the compaction chamber of a refuse baler according to the present invention taken along the line 9-9 of FIG. 5.

Construction of platen 16 is best understood with reference to FIGS. 6 and 9. Platen 16 comprises a platen frame 60 and a platen face 61 located on the forward end of platen frame 60. Platen frame 60 has the same general cross-sectional configuration as housing 11 and is sized to slide within housing 11. Wear pads are provided to maintain contact and even spacing between platen frame 60 and the inside of housing 11. Platen face 61 is comprised of a plurality of parallel, vertical "U" shaped platen beams 63 attached to one end to the front of the top of platen frame 60 and at the other end to the front of the bottom of platen frame 60. Platen beams 63 are oriented in such a manner that the webs of platen beams 63 face forwardly toward compaction chamber 15 to form platen face 61. Platen beams 63 are spaced to define a number of parallel channels 64 between them. Each platen beam 63 is aligned with a corresponding ceiling beam 38 and floor beam 40 such that channels 64 align with corresponding channels 39, 41 and 55. Thus, it will be seen that each set of aligned channels 39, 41, 55 and 64 form a continuous channel around compaction chamber 15 when platen 16 is located between positions B and C.

A platen shear bar 65 is attached to the top of platen face 61. Platen shear bar 65 has a forward facing cutting edge 66 and a plurality of slots 67 which are aligned and communicate with channels 64. Slots 67 permit the introduction of tying members into channels 64 when the tying process is commenced as described below. Shear bar 65 will act to cut through and shear off any material deposited in chute 24 that does not fit within hopper portion 14 as platen 16 passes from hopper portion 14 toward compaction chamber 15.

A stop plate 70 is attached across vertical members of compaction chamber frame 34 below the front of hopper portion 14. Stop plate 70 is positioned such that it will lie beneath channels 64 in platen face 61 when platen 16 is in position B. A horizontal rod 71 is attached across the bottom of floor beams 40 slightly forward of stop plate 70 as shown.

Figure 11:
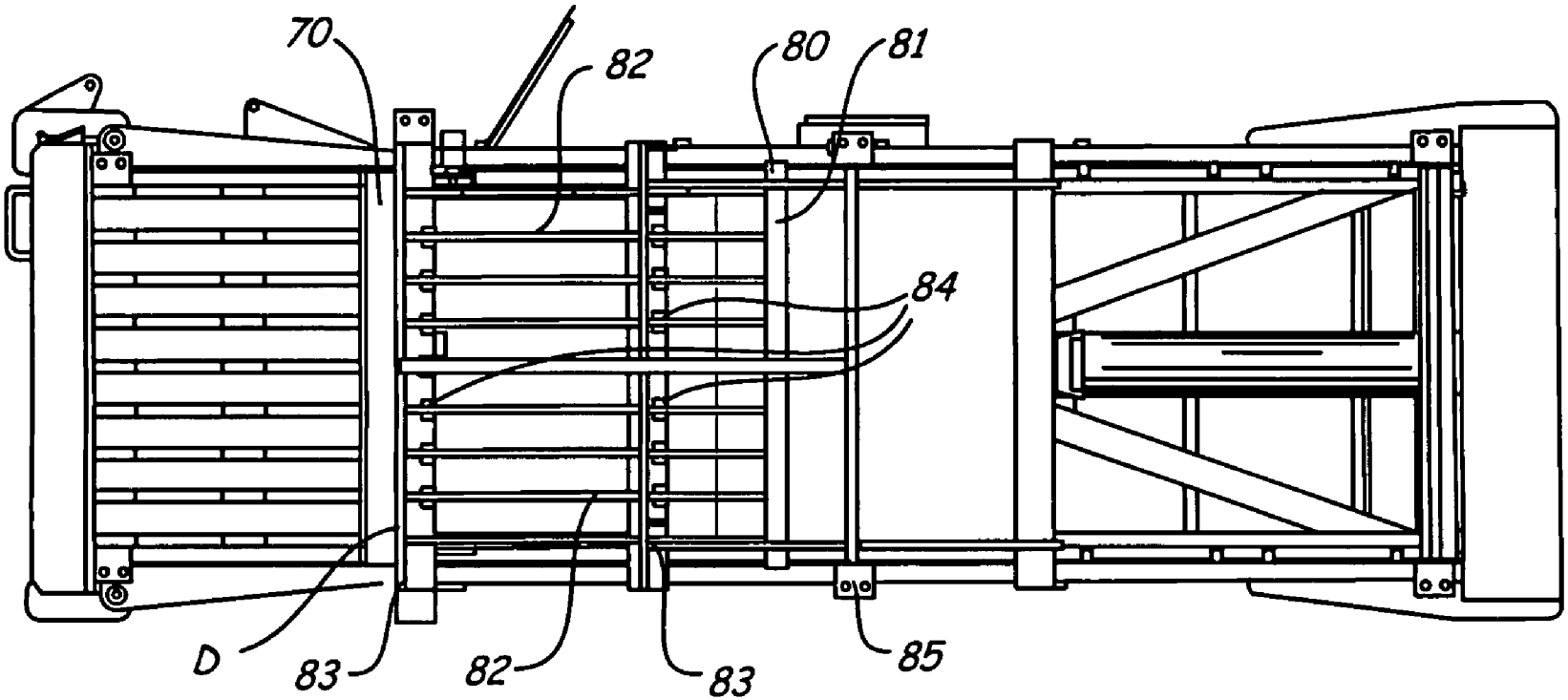
FIG. 11 is a bottom elevational view of a baler tie feed apparatus according to the present invention.
Figure 12:
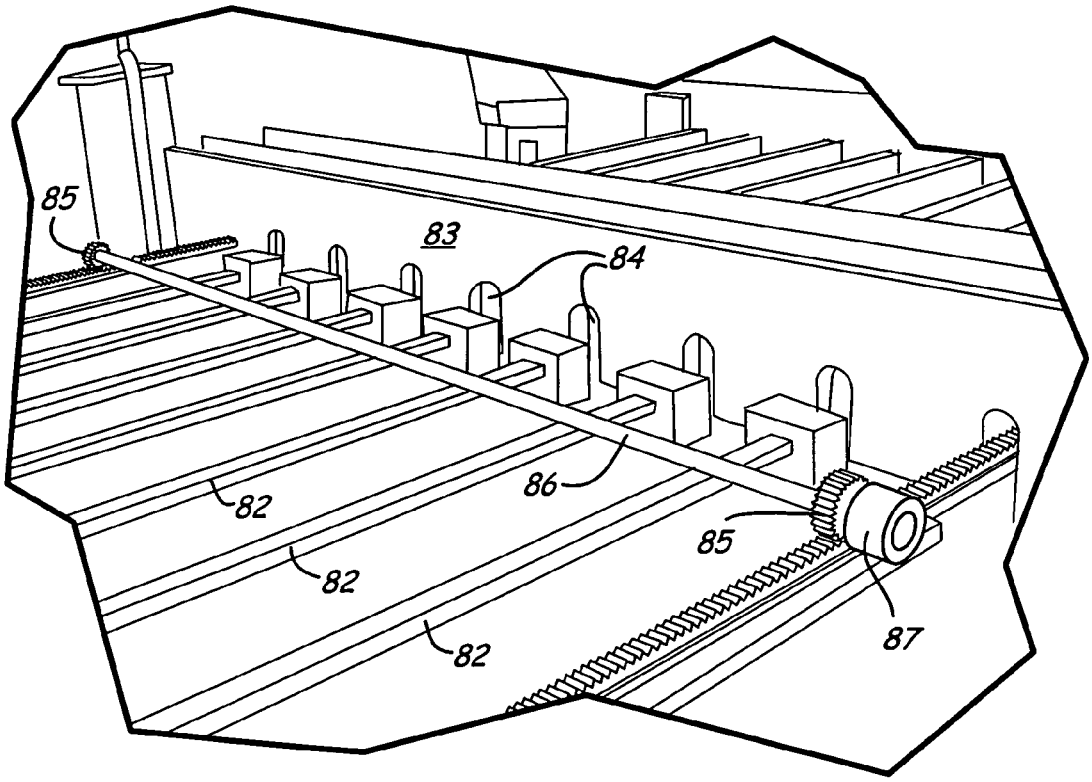
FIG. 12 is a fragmented bottom perspective view of a tie feed apparatus and rack and pinion drive of a baler tie feed apparatus according to the present invention.

As best seen in FIG. 11, a tie guide mechanism 80 is attached to and operable on the underside of housing 11. Tie guide mechanism 80 comprises a transverse bar 81 and a plurality of tie push rods 82 attached to tie transverse bar 81 at one end and extending forwardly therefrom. Tie guide mechanism 80 is suspended beneath housing 11 by means of suspension brackets 83 extending downwardly from the bottom of housing 11 and bearing pads attached to suspension brackets 83, with two or more of tie push rods 82 riding on bearing pads as shown. The number of tie push rods 82 is equal to the number of channels 41 in the bottom portion 32 of compaction chamber 15. Tie push rods 82 are aligned with channels 41 such that one tie push rod 82 is operable within and along length of each channel 41. The length of tie push rods 82 is greater than the length of compaction chamber 15. Tie guide mechanism 80 is operable between a position D wherein the forward ends of tie push rods 82 are located slightly rearwardly of platen face 61 when platen 16 is in position B and a position E wherein the forward ends of tie push rods 82 extend forwardly of the front of door 21. Tie guide mechanism 80 is moved between position D and position E by means of a rack and pinion mechanisms 85 wherein a rack is located on the underside of each of the outer tie push rods 82 and engage a corresponding pinion rotatable on a shaft 86 attached to a motor 87. By operating motor 87 in a forward or backward manner, the rack and pinion mechanisms 85 will cause tie guide mechanism 80 to move forward or backward. Rack and pinion mechanisms 85 is operable by conventional control means (either manual or automatic).

The forward end of each tie push rod 82 is notched as at notches to engage a tie when a tie is inserted down through the channels 55 in platen face 61 as described below.

Figure 13A:
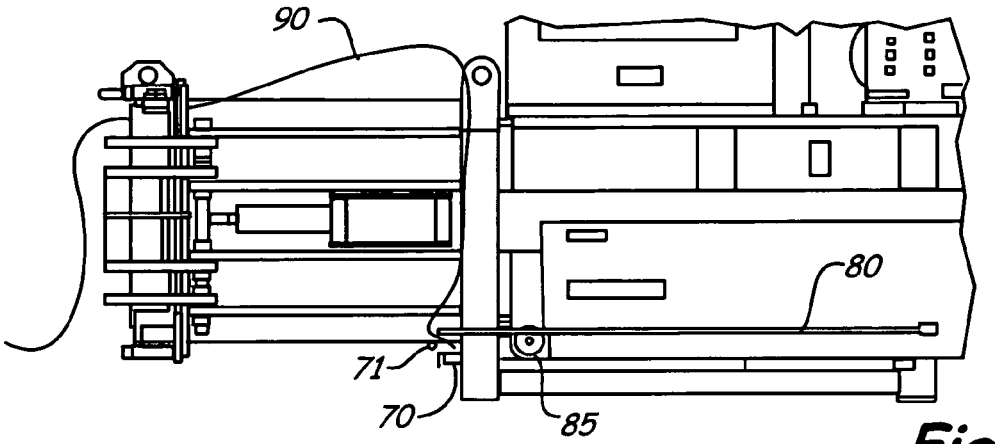
FIGS. 13*a*, 13*b* and 13*c* are side sectional views of a baler tie feed apparatus according to the present invention showing a bale tie wire in various stages of wrapping a bale.
Figure 13B:
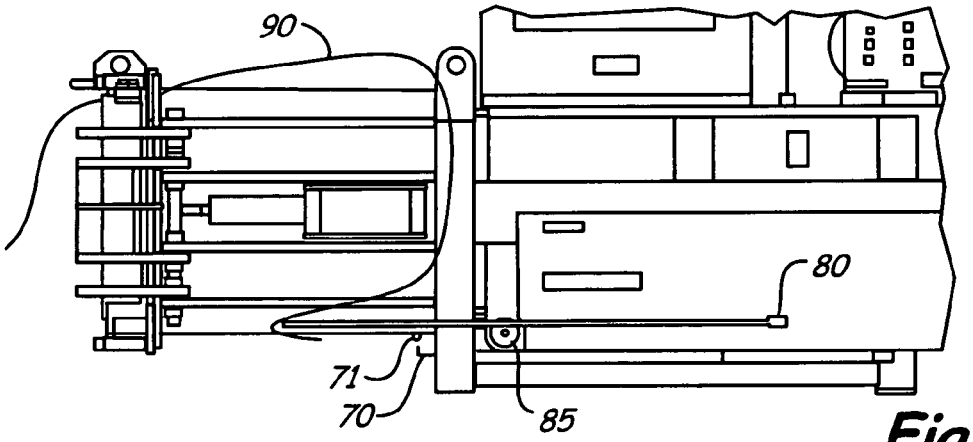
Figure 13C:
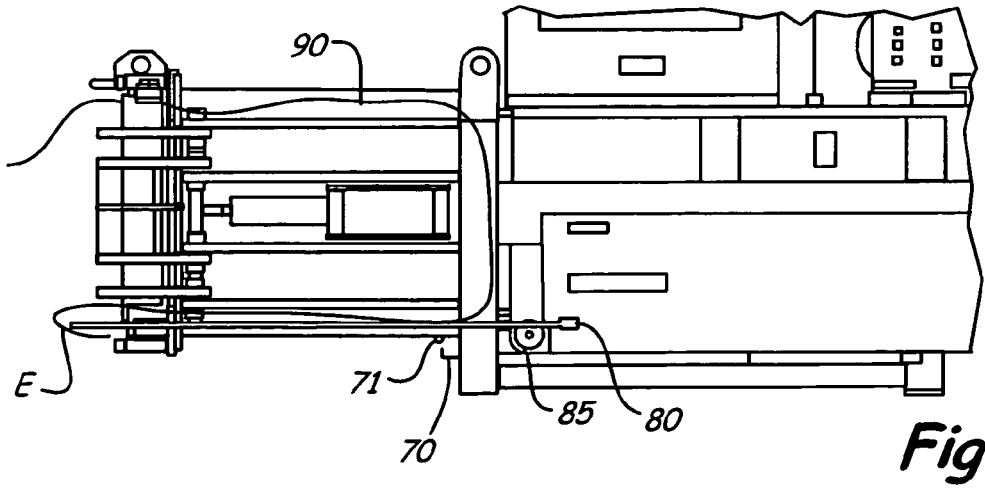

Operation of tie guide mechanism 80 is best understood with reference to FIGS. 13*a* to 13*c*. Once a bale of compacted material is fully formed, platen 16 is returned to position B, whereby the bale is contained entirely within compaction chamber 15. A bale tie wire 90 is inserted beneath frame 12 adjacent the front of baler 10 into each of the ceiling channels 39 and each of the corresponding platen channels 64 until tie wire 90 is stopped by coming into contact with stop plate 70. Once a tie wire 90 is so inserted through all channels 64, rack and pinion mechanisms 85 are activated to move tie guide mechanism 80 forward from position D toward position E. As tie guide mechanism 80 is moved forwardly, notches in the forward end of each tie push rod 82 engage the corresponding tie wire 90 at a point slightly above its end and push it forwardly. As the ends of tie wires 90 move forward, the end of tie wires 90 come into contact with rod 71 which causes the ends of tie wires 90 to be bent back against themselves thereby securing tie wires 90 in corresponding notches while tie wires 90 are threaded through the corresponding channels 41 in the bottom portion 32 of compaction chamber 15.

Once tie guide mechanism 80 is advanced to position E, the ends of tie wires 90 are manually advanced through the corresponding channels 55 in door 21 until tie wires 90 completely encircle the bale. Tie wires 90 are then cut and the opposed ends wrapped or otherwise secured. When all tie wires 90 have been so secured, door 21 is opened by releasing latch mechanism 22 and platen 16 is activated to advance it from position B toward position C, thereby expelling the bale from compaction chamber 15.

While we have described the preferred embodiment of our invention, it will be evident to those skilled in the art that other embodiments may be possible within the scope of our invention.

What is claimed is:

1. A baler tie feed apparatus for securing a bale of compacted material formed in a baler having a compaction chamber for receiving material to be compacted and having a top, bottom and sides, a platen movable from a rear position to a forward position for compacting material within the compaction chamber into a bale and a door operable between a closed position when the bale is being formed and an open position when the bale is being discharged from the baler, comprising:

(a) plurality of spaced channels defined in said top and bottom of said compaction chamber;

(b) a plurality of spaced channels defined in said platen, each of said platen channels being aligned with one of said spaced open channels in said top and bottom of said compaction chamber;

(c) a plurality of spaced channels defined in said door, each of said door channels being aligned with one of said channels in said top and bottom of said compaction chamber, whereby the aligned channels for a plurality of spaced channels surrounding a bale formed within said baler through which a plurality of bale ties may be inserted;

(d) a tie guide mechanism positioned beneath said compaction chamber having a plurality of tie engaging members, each of said tie engaging members being operable within said channels defined in said bottom of said compaction chamber and having a forward end defining means for engaging a tie, said tie guide mechanism being operable between a first position wherein said forward end of each of said tie guide members is positioned beneath one of said channels defined in said platen and a second position wherein said forward end of each of said tie guide members extends through one of said channels defined in said door; and (e) means for moving said tie guide mechanism between said first position and said second position.

2. A baler tie feed apparatus according to claim 1, wherein said means for moving said tie guide mechanism comprises a rack attached to one of said tie engaging members, a pinion engaging said rack and mounted on a shaft, and a motor operable to rotate said shaft.

3. A baler tie feed apparatus according to claim 1, wherein said platen further comprises a shear member attached to the top of said platen, said shear member defining slots aligned with said channels.

4. A baler tie feed apparatus according to claim 1, wherein said tie engaging means comprises a notch formed in said forward end of each of said tie engaging members.

5. A baler tie feed apparatus for securing a bale of compacted material formed in a baler comprising:

(a) a compaction chamber for receiving material to be compacted and having a top, bottom and sides, and a plurality of spaced channels defined in said top and bottom of said compaction chamber;

(b) a platen movable within said compaction chamber from a rear position to a forward position for compacting material within the compaction chamber into a bale, said platen defining a plurality of spaced channels, each of said channels of said platen being aligned with a channel in said top of said compaction chamber and with a channel in said bottom of said compaction chamber;

(c) a door attached to one end of said compaction chamber and being operable between a closed position and an open position, said door defining a plurality of spaced channels, each of said channels of said door being aligned with a channel in said top of said compaction chamber and with a channel in said bottom of said compaction chamber so as to define a plurality of continuous channels surrounding a bale formed within said compaction chamber;

(d) a tie guide mechanism positioned beneath said compaction chamber having a plurality of tie engaging members, each of said tie engaging members being operable within said channels defined in said bottom of said compaction chamber and having a forward end defining means for engaging a tie, said tie guide mechanism being operable between a first position wherein said forward end of each of said tie guide members is positioned beneath one of said channels defined in said platen and a second position wherein said forward end of each of said tie guide members extends through one of said channels defined in said door; and (e) means for moving said tie guide mechanism between said first position and said second position.

6. A baler tie feed apparatus according to claim 5, wherein said means for moving said tie guide mechanism comprises a rack attached to one of said tie engaging members, a pinion engaging said rack and mounted on a shaft, and a motor operable to rotate said shaft.

7. A baler tie feed apparatus according to claim 5, wherein said platen further comprises a shear member attached to the top of said platen, said shear member defining slots aligned with said channels.

8. A baler tie feed apparatus according to claim 5, wherein said tie engaging means comprises a notch formed in said forward end of each of said tie engaging members.

9. A baler tie feed apparatus for securing a bale of compacted material formed in a baler comprising:

(a) a compaction chamber for receiving material to be compacted and having a top, bottom and sides, and a plurality of spaced channels defined in said top and bottom of said compaction chamber;

(b) a platen movable within said compaction chamber from a rear position to a forward position for compacting material within the compaction chamber into a bale, said platen defining a plurality of spaced channels, each of said channels of said platen being aligned with a channel in said top of said compaction chamber and with a channel in said bottom of said compaction chamber, said platen having a shear member attached to the top of said platen, said shear member defining slots aligned with said channels;

(c) a door attached to one end of said compaction chamber and being operable between a closed position and an open position, said door defining a plurality of spaced channels, each of said channels of said door being aligned with a channel in said top of said compaction chamber and with a channel in said bottom of said compaction chamber so as to define a plurality of continuous channels surrounding a bale formed within said compaction chamber;

(d) a tie guide mechanism positioned beneath said compaction chamber having a plurality of tie engaging members, each of said tie engaging members being operable within said channels defined in said bottom of said compaction chamber and having a forward end defining a notch for engaging a tie, said tie guide mechanism being operable between a first position wherein said forward end of each of said tie guide members is positioned beneath one of said channels defined in said platen and a second position wherein said forward end of each of said tie guide members is positioned beneath one of said channels defined in said door; and (e) a rack attached to one of said tie engaging members, a pinion engaging said rack and mounted on a shaft, and a motor operable to rotate said shaft.

* * * * *